US011279458B2

(12) United States Patent
Michaeli et al.

(10) Patent No.: US 11,279,458 B2
(45) Date of Patent: Mar. 22, 2022

(54) LOW PROFILE VENT ASSEMBLY FOR A BOAT

(71) Applicant: Ockerman Automation Consulting, Inc., Anacortes, WA (US)

(72) Inventors: Jennifer Michaeli, Smithfield, VA (US); Robert Walling, Pine Beach, NJ (US); Alden Nelson, Norfolk, VA (US)

(73) Assignee: Ockerman Automation Consulting, Inc., Anacortes, WA (US)

( * ) Notice: Subject to any disclaimer, the term of this patent is extended or adjusted under 35 U.S.C. 154(b) by 80 days.

(21) Appl. No.: 16/816,051

(22) Filed: Mar. 11, 2020

(65) Prior Publication Data

US 2021/0284315 A1 Sep. 16, 2021

(51) Int. Cl.

| | |
|---|---|
| ***B63J 2/10*** | (2006.01) |
| ***B63B 79/15*** | (2020.01) |
| ***F24F 13/10*** | (2006.01) |
| ***F24F 7/06*** | (2006.01) |
| ***B63J 2/08*** | (2006.01) |

(52) U.S. Cl.

CPC ..... *B63J 2/10* (2013.01); *B63B 79/15* (2020.01); *B63J 2/08* (2013.01); *F24F 7/065* (2013.01); *F24F 13/10* (2013.01)

(58) Field of Classification Search

CPC .... B63J 2/10; B63J 2/08; B63B 79/15; B63B 19/04; F24F 7/065; F24F 13/10

See application file for complete search history.

(56) References Cited

U.S. PATENT DOCUMENTS

| | | | |
|---|---|---|---|
| 1,556,270 | A | 10/1925 | Welle |
| 3,502,361 | A | 3/1970 | Sieverin |
| 8,418,812 | B1 | 4/2013 | Rosen et al. |
| 2005/0279269 | A1 | 12/2005 | Robinson et al. |
| 2008/0099080 | A1 | 5/2008 | Saini et al. |
| 2010/0263745 | A1 | 10/2010 | Symes |

(Continued)

FOREIGN PATENT DOCUMENTS

| | | | | |
|---|---|---|---|---|
| CN | 203975138 U | | 12/2014 | |
| GB | 595415 A | * | 12/1947 | ..... B63B 19/04 |
| GB | 769155 A | | 2/1957 | |

(Continued)

OTHER PUBLICATIONS

International Search Report and Written Opinion for PCT Application No. PCT/US2021/021996, dated May 28, 2021.

(Continued)

*Primary Examiner* — Anthony D Wiest

(74) *Attorney, Agent, or Firm* — Dorsey & Whitney LLP

(57) ABSTRACT

A vent assembly in accordance with some examples herein may include a vent conduit coupling a dry compartment of a boat to an opening in a hull of the boat for selectively fluidly connecting the dry compartment to an exterior of the hull. The vent assembly may include a fluid-tight ventilation closure which selectively prevents fluid flow through the vent conduit when the fluid-tight ventilation closure is in a closed position. The fluid-tight ventilation closure may be positioned below an exterior surface of the hull. A damper may be configured to selectively modulate air flow through the vent conduit. The damper may be positioned downstream of the fluid-tight ventilation closure from the opening.

31 Claims, 7 Drawing Sheets

(56) References Cited

U.S. PATENT DOCUMENTS

2011/0092113 A1 4/2011 Mataya

FOREIGN PATENT DOCUMENTS

| | | | | |
|---|---|---|---|---|
| KR | 200341321 | Y1 | * | 2/2004 |
| KR | 200389370 | Y1 | * | 7/2005 |
| KR | 20150002641 | U | * | 7/2015 |
| WO | 2019185968 | A1 | | 10/2019 |

OTHER PUBLICATIONS

U.S. Appl. No. 16/816,062 titled "Flush-Mount Valve" filed Mar. 11, 2020.

* cited by examiner

LOW PROFILE VENT ASSEMBLY FOR A BOAT

TECHNICAL FIELD

Examples described herein relate generally to a low profile vent assembly and method for fluidly sealing an opening in a hull of a boat while preserving the hull profile of the boat.

BACKGROUND

In enclosed spaces on a boat, such as in enclosed dry compartments of the boat (e.g., the engine compartment, cargo area, or crew compartment), or in enclosed spaces of other vessels or industrial facilities where internal temperature control may be needed, ventilation ducting, fans and ancillary equipment are often installed to facilitate regulation of the internal temperature. A ventilation system may be used to provide air into the enclosed compartment e.g., to operate the machine and/or to cool machinery such as prime movers, electronics, reactors, or other equipment that generates heat. In boats, ventilation may be desired for any internal fluid tight compartment of the boat (also referred to as dry areas or compartments), and such ventilation typically requires the use of one or more vent openings, conventionally provided at the end of structures extending above the deck of the boat so as to avoid or reduce the risk of the vent openings being downflooding points on the vessel. Such conventional solutions, however, may negatively impact the vessel profile that may affect it aesthetically, with regard to safety, or observability.

SUMMARY

Described here are examples of a low profile vent assembly for a boat. The vent assembly includes a vent conduit coupling a dry compartment of a boat to an opening in a hull of the boat for selectively fluidly connecting the dry compartment to an exterior of the hull. A fluid-tight ventilation closure selectively prevents fluid flow through the vent conduit when the fluid-tight ventilation closure is in a closed position. The fluid-tight ventilation closure is positioned below an exterior surface of the hull. A damper is configured to selectively modulate air flow through the vent conduit and is positioned downstream of the fluid-tight ventilation closure from the opening.

The fluid-tight ventilation closure may include a fluid-tight valve configured to selectively allow fluid communication from an internal space defined within a hull of the boat when the valve is in an open position, and to prevent the passage of fluid across the valve (e.g., into the internal space) when the valve is in a closed position. The low profile vent assembly may include a drain configured to dispose of any fluid that has collected into the low profile vent assembly (e.g., within the vent conduit) such as to prevent passage of the fluid into the internal space of the boat.

In some embodiments, the low profile vent assembly may include an air mover configured to move air through the internal space of the boat. In some embodiments, the low profile vent assembly includes a water ingress sensor to detect the ingress of water. Some examples of water ingress sensors include conductivity or float sensors. In some embodiments, the fluid-tight ventilation closure is closed upon a detection of a condition corresponding to a threat of an ingress of water into the internal space of the boat. In some embodiments, the condition is correlated to one of a roll, a pitch, or a yaw of the boat, and may be detected by an accelerometer. In some embodiments, the detection of the condition is correlated to the listing of the boat. In some embodiments, the fluid-tight ventilation closure is a valve that is automatically closed in response to detection of the condition. In some embodiments, the damper is fire-rated and configured to close upon the detection of a fire. In some embodiments, a fire may be detected by a sensor arranged to detect: a temperature of the internal space rising above a threshold, the presence of smoke in the internal space, a time rate of temperature rise, a wavelength of light associated with the fire, or any combinations thereof.

In some embodiments, the low profile vent assembly includes a valve with a flange fixed to a deck of the boat; an aperture defined in the flange that allows the fluid communication from a peripheral inner surface to an outer surface of the deck; a protrusion extending around the peripheral inner surface; a cylinder structure extending inward into the internal space from the peripheral inner surface of the valve below the flange. The cylinder structure may include a passage portion including a plurality of circumferentially spaced apart openings that provide fluid communication between the internal space and the aperture. The valve includes a shaft structure positioned within the cylinder structure and operable to move relative to the cylinder structure and relative to the aperture. The shaft structure includes a retaining groove at a top end of the shaft structure, and a resilient seal disposed in the retaining groove and operable to seal against the protrusion to prevent the ingress of water into the boat. In some embodiments, the shaft structure includes a longitudinal axis about which the shaft structure rotates, and a set of shaft structure threads. The cylinder structure includes a set of cylinder threads that mate with the shaft structure threads such that the cylinder structure guides the shaft structure upward and downward between a sealed and an unsealed configuration of the valve as the shaft structure rotates relative to the cylinder structure.

A method of preventing downflooding of a boat is disclosed. The method includes providing a low profile vent assembly as disclosed herein. The method includes detecting a condition corresponding to a threat of an ingress of water into the dry compartment of the boat. In various embodiments, the condition corresponds to a roll, a pitch, a yaw, or listing of the boat. The method includes generating a control signal in response to the detection of the condition, actuating an actuator in response to the control signal, and closing the fluid-tight ventilation closure of the low profile vent assembly In some embodiments, the method includes detecting the ingress of water into the internal space of the boat; closing the fluid ventilation closure; and collecting and disposing of the ingressed water.

In some embodiments, the method includes detecting a fire; and closing the damper. In various embodiments, the method includes detecting the fire by detecting a temperature of the internal space rising above a threshold; a presence of smoke in the internal space; a time rate of temperature rise; or a wavelength of light associated with the fire.

DETAILED DESCRIPTION

Figure 1A:
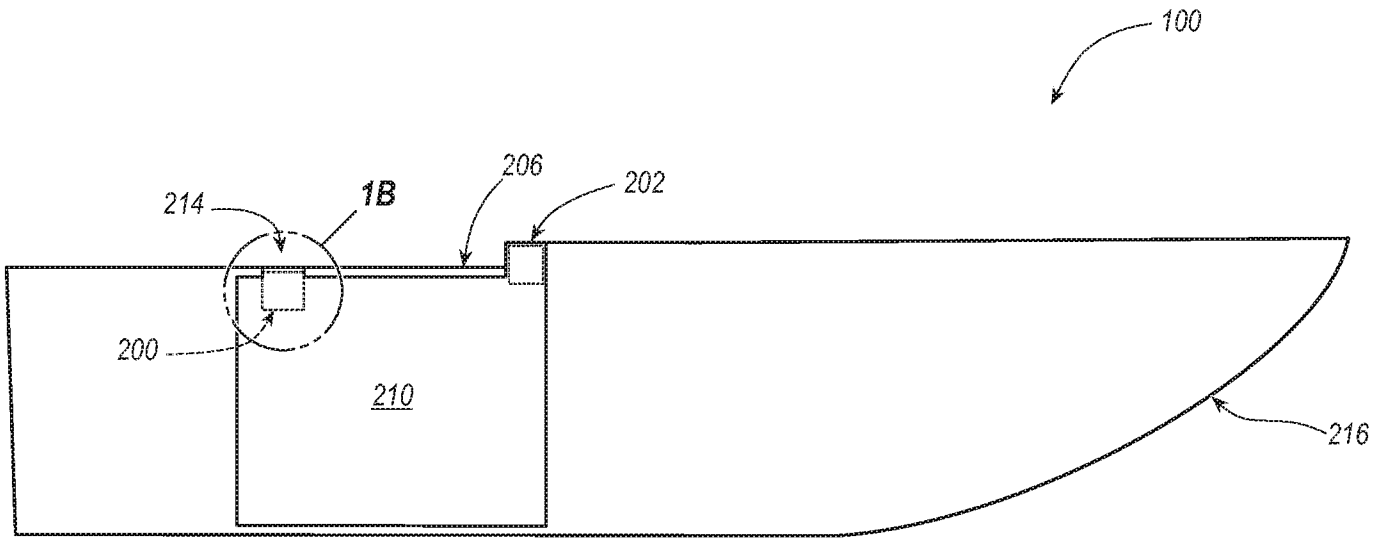
FIG. 1A is a simplified illustration of a boat with an internal compartment and a low profile vent assembly operatively associated with an opening to the internal compartment in accordance with the present disclosure.

Described here are examples of low profile vent assemblies which may be used to provide a fluid-tight seal across a vent opening, for example an air intake or outlet of an engine compartment of a boat to reduce the risk of downflooding while preserving a low profile of the boat. A low profile vent assembly may be desirable for aesthetics, safety or observability of a boat. For example, a low profile vent assembly may be included in a boat without affecting the aesthetics, safety or observability of the boat. In some embodiments, the vent assembly includes a vent conduit, which couples a dry compartment of the boat to an opening in the hull of the boat for selectively fluidly connecting the dry compartment to an exterior of the hull. As used herein, "selectively fluidly connecting" refers to an ability of a fluid-tight ventilation closure according to the present disclosure to establish, sever, regulate, or control fluid communication between one portion of a boat and one or more of: the exterior of environment around the boat, and another portion of the boat, and to do so based on an input or command (either electrical or physical) from an external controller, actuator, a sensor, or a person. The low profile vent assembly may include a fluid-tight ventilation closure that prevents fluids from passing into, or out of, the boat. The fluid-tight ventilation closure may include a valve operatively associated with the vent conduit. The valve is operable to selectively prevent the flow of fluids (e.g., water or other liquids) through the vent conduit when the valve is in the closed position. The valve may be positioned, e.g., within the conduit, such that it lies below the exterior surface of the hull. For example, the valve may include a valve housing, which may form at least a portion of the vent conduit. The valve housing may be mounted to the hull such that is extends downward from the hull. The valve may also include a valve barrier which is movable in relation to the housing between the open and closed positions. The valve housing may be configured to substantially enclose moving components of the valve (e.g., the valve barrier). As such, when operatively mounted to the hull, the entirety of the valve, regardless of whether it is in the open or closed position, is located below the exterior surface of the hull thereby maintaining the vessel's hull profile.

In some embodiments, the vent assembly also includes a damper which is configured to selectively modulate (e.g., to increase or decrease) the air flow through the vent conduit. In some embodiments, the damper may be positioned downstream or below the valve and thus selectively fluidly sealing the valve may avoid ingress of fluids (e.g., water) into the damper and reduce the risk of damage to the damper. The valve of the low-profile vent assembly may be implemented using any suitable flow control device that is capable of providing a fluid-tight seal that substantially prevents the passage of a fluid (e.g., water or air) across the barrier of the valve. The damper may be implemented using any suitable gas flow control device that is capable of modeling (e.g., increasing and decreasing as desired) and/or substantially blocking or sealing the passage of gas across the damper. As such a vent assembly according to the present disclosure may operatively couple any suitable fluid flow control device and any suitable gas flow control device, in some embodiments in series within a conduit that connects the internal space (e.g., dry compartment of a boat) to the exterior (e.g., an exterior of the hull of the boat) via a vent opening (such as an opening formed in the hull of the boat). In some such embodiments, the passages of the valve and damper may be coaxially aligned. In other embodiments, the valve and damper may be coupled in parallel, for example by not having the respective flow passage of the valve and the damper axially aligned but being arranged to extend along adjacent (e.g., parallel) axes.

FIG. 1 shows an illustration of a boat 100, which has a hull 216 and an internal compartment 210 defined within the hull 216. The internal compartment 210 may be any dry compartment or area of the boat, such as an engine compartment, electronics room, weapon systems room, a crew cabin, a cargo area, etc. One or more openings in the hull 216, such as the air intake 202 and the air outlet 214, which provide air from the ambiance (e.g., from the exterior of the boat) into the internal compartment 210 and allow air to exit the internal compartment 210, respectively, may provide the internal compartment 210 in communication with the exterior the hull 216.

Figure 1B:
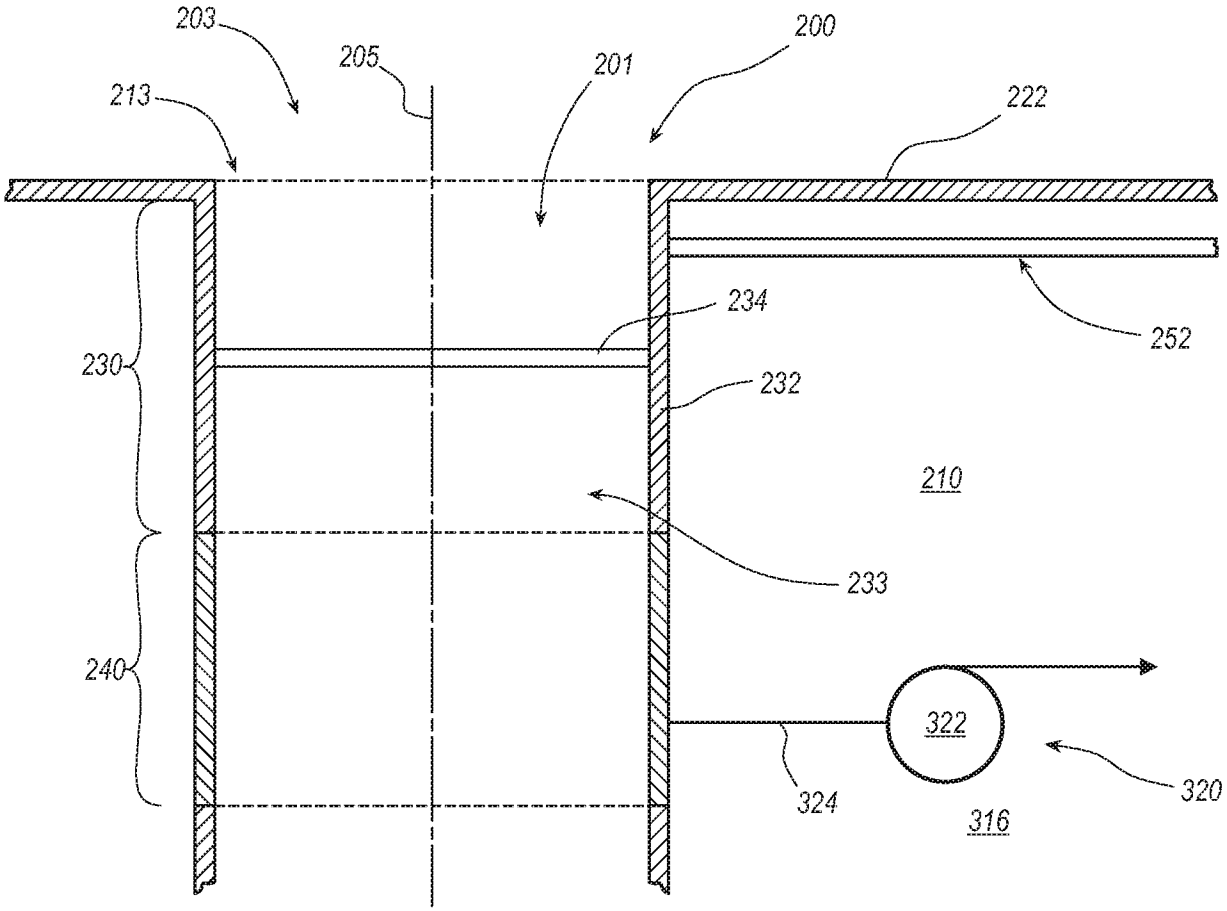
FIG. 1B is a simplified illustration of a low profile vent assembly according to the present disclosure, which may be used with the internal compartment of the boat in FIG. 1.
Figure 2:
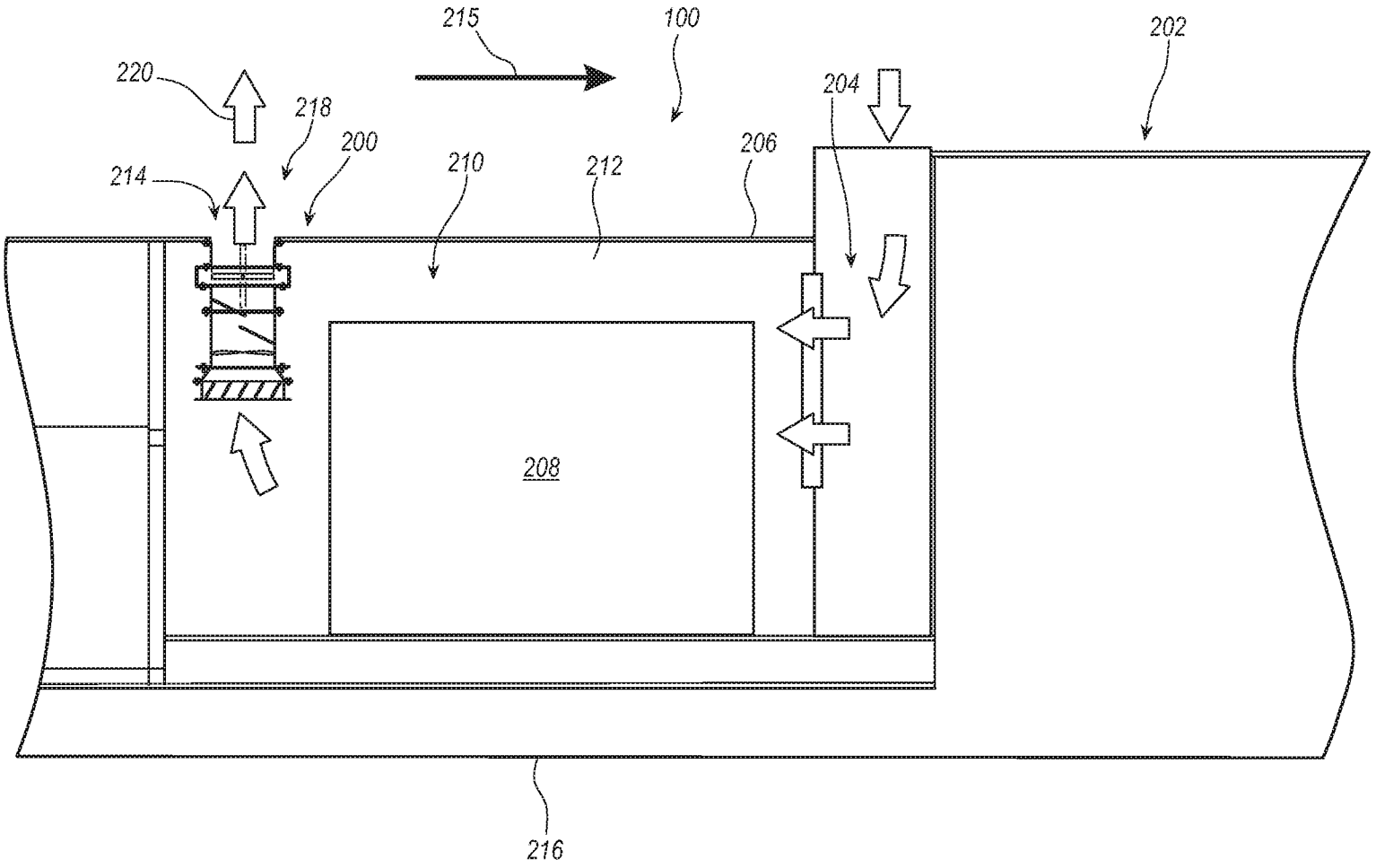
FIG. 2 illustrates a machinery space of a boat that may be equipped a fluid-tight ventilation closure in accordance with the present disclosure.

The internal compartment 210 may be an engine compartment 212, as shown in FIG. 2, or other machinery space. The engine compartment 212 houses components of the boat's propulsion system 208, such as one or more engines, which may include an internal combustion engine, one or more electric motors, at least one energy storage device such as a battery or capacitor, and/or other energy generation or storage components (e.g., a nuclear reactor, a jet engine, or others). While embodiments of the low profile vent assembly are described here in the context of fluidly-sealing an internal compartment 210 of a boat, the vent assemblies herein may be used in other application, such as for venting enclosed spaces or compartments of any other type of vessel or industrial facility. In the present example of a boat 100, as shown in FIG. 1, the internal compartment 210 may additionally or alternatively house electronics such as navigation equipment, radar systems, vehicles adapted for use on land or water, weapons systems, or countermeasures. The internal compartment 210 may house or enclose other devices that may require air to operate and/or which generate heat to be dissipated. For example, the internal compartment 210 may be a crew compartment adapted to house people or animals. In some embodiments, a crew compartment may be ventilated according to the methods and systems disclosed herein.

In a boat 100 that has low freeboard or which may selectively be operated in a low freeboard state (e.g., through selective ballasting), vent openings in the boat's hull 216, such as air inlets or intakes, air outlets or other similar vent openings, can be vulnerable to the ingress of fluid (e.g., water) thus potentially becoming downflooding points that can affect the seaworthiness of the boat 100, in either operational and damaged condition. A low freeboard, in the context of the present disclosure, may refer to a state or configuration of the boat in which the freeboard of the boat is approximately equal to or below the height of a wave or other water disturbance in which the boat is designed to operate. In some cases, it may be advantageous to provide an opening on a surface of the hull 216, such as on the deck 206 of the boat 100 as shown in FIG. 1, which may minimize adverse impact to the observability profile of the boat. However such opening may increase the risk of flooding of the boat 100, as such openings are more likely to be exposed to contact with or submersion under water.

Accordingly a low profile vent assembly 200 with a fluid-tight ventilation closure 203 is described here, which is configured to selectively provide a fluid-tight seal across the barrier of the vent assembly. The low profile vent assembly 200 may be configured to selectively fluidly seal a vent opening, such as the vent opening in a boat (e.g., a vent of the engine compartment 212 such as air intake 202 or air outlet 214) while maintaining a low profile by substantially eliminating any structures projecting from the outer surfaces of the outer hull (e.g., from the outer surface of the deck 206).

FIG. 1B illustrates a vent assembly 200 according to the present disclosure, which may be used across a vent of an internal compartment 210 of the boat 100 in FIG. 1A. The vent assembly 200 shown in FIG. 1B includes a vent conduit 201 connecting an opening 213 in an exterior surface 222, such as an exterior hull 216 surface of a boat 100, to an internal compartment 210, such as a dry compartment of the boat 100. The vent conduit 201 may have a longitudinal axis 205 that is substantially parallel to the flow of gas through the conduit. The vent assembly 200 shown in FIG. 1B also includes fluid-tight ventilation closure 203 with a valve portion or simply a valve 230 and a damper portion or simply damper 240. The valve 230 is operable to provide a fluid tight seal, when provided in a closed positon, such as to substantially prevent the passage of a fluid (e.g., water or any other liquid) through the valve.

The vent assembly 200 includes a damper 240 operable to modulate (e.g., increase and decrease) the flow of a gas (e.g., air) through the damper 240 and in some cases substantially block the passage of the gas (e.g., air) through the damper 240, which may provide a fire mitigation function. The valve 230 and damper 240 are arranged in series, with both the valve 230 and the damper 240 positioned substantially completely below the surface 222. As shown in FIG. 1B, the entirety of the valve 230 and the damper 240 may be located within the compartment 210. The valve 230 and the damper 240 are mounted below the surface 222 such that they extend downward into the cavity defined by the hull 206, rather than projecting from any exterior surface of the hull 216 such as surface 222.

The valve 230 may include a housing 232, which may be mounted to the surface 222 such that it lies below the surface 222. The housing 232 defines a passage 233 which forms a portion of the vent conduit 201. The valve 230 includes a barrier mechanism or simply barrier 234, which is movably coupled to the housing to enable actuation of the valve 230 between the open and closed positions. The type and articulation of the barrier mechanism 234 may be different in different embodiments, based on the type or structural arrangement of the valve 230 used. For example, in some embodiments, the barrier mechanism 234 may be configured to translate relative to the housing 232 (e.g., up and down within the vent conduit 201 along the longitudinal axis 205) between the open position and the closed position. In some such embodiments, the housing 232 may be a cylindrical tubular housing, the length of which may define the height of the valve 230. The barrier 234 may be cylindrical block or plug, which is threadedly coupled to the cylindrical tubular housing, enabling the cylindrical plug to be translated along the length of the housing and thus up and down in relation to the height of the valve. An example of a valve having this type of configuration is described further with reference to FIGS. 4-6.

In other embodiments, the barrier 234 may pivot relative to the housing 232 to provide the valve between the open and the closed positions. For example, the barrier 234 may pivot about a transverse axis 207 between open and closed positions. The transverse axis 207 may be orthogonal to the longitudinal axis 205 of the conduit 201. The barrier 234 may be implemented as a plate (e.g., a disk in the case of a cylindrical housing) having a length dimension (e.g., a diameter of the disk in the case of the circular embodiment). In some such examples, the barrier 234 may be a rotatable plate configured to rotate or pivot about an axis that runs perpendicular to the height dimension of the valve 230. The barrier 234 may be pivoted off an edge of the plate (e.g., as in the example in FIG. 7) or it may be pivoted about a central location of the plate (e.g., in the case of a butterfly-type valve). In some embodiments, the housing 232 and the barrier plate 234 may have a cylindrical/circular geometry. In other embodiments, the barrier plate 234 may have a non-circular geometry. The barrier plate 234 and the tubular housing may have a rectangular shape, as long as the cross section and dimensions of the housing 232 are selected to receive and accommodate rotation of the barrier plate 234 within the housing 232. The housing 232 may be sufficiently large to substantially fully enclose the barrier plate 234 in its open position. For example, the length 211 of the housing 232 may be equal to or greater than the length 209 of the plate 234 such that the plate remains fully enclosed within the housing 232. In other embodiments, the length of the housing 232 may be less than the length of the barrier plate 234 as long as any portion of the movable barrier plate 234, when articulated either to the open or closed position remains substantially flush with or below the outer surface 222.

In some embodiments, the vent assembly 200 may include a drain system or simply drain that includes a drain conduit 252 fluidly connected to the vent conduit 201 and to the exterior of the hull 216 to allow for fluid that accumulates above the barrier 234 to drain to the exterior of the hull 216 rather than into the internal compartment 210. In some such examples, the opening of the drain conduit 252 may be elevationally above the barrier 234. As shown in FIG. 1B, the drain conduit 252 may be fluidly connected to the housing 232 of valve 230 at a location between the opening 213 and the barrier mechanism 234.

As shown in FIG. 2, the air outlet 214 can be a downflooding point 218 for boat 100 in certain operational conditions such as when the boat is operating in low freeboard mode. In various embodiments described herein, a low profile vent assembly 200 is operatively associated with an opening in the outer hull 216 of the boat 100, such as to reduce or prevent the ingress of fluid (e.g., water) into the opening, which may be an intake such as the air intake 202 or a vent such as air outlet 214.

In the example in FIG. 2, in which the internal compartment 210 is shown as an engine compartment 212, the low profile vent assembly 200 is associated with the opening 214 that serves as an air outlet 214. In some embodiments, a low profile vent assembly 200 may additionally or alternatively be provided at any other openings associated with the engine compartment such as the air intake 202. The air intake 202 is operatively arranged to couple the internal compartment 210 to the exterior of the hull 216 such as to allow air to pass from the exterior of the hull 216 into the internal compartment 210. The air entering through the air intake 202 may optionally pass through an air intake plenum 204 before entering the internal compartment 210. The air intake plenum 204 may be configured to collect and direct the air entering from multiple hull openings (e.g., one or more air intakes) into the internal compartment, here the engine compartment 212. In some embodiments, the air intake plenum 204 may operatively distribute air from one or more openings into one or more internal compartments of the boat 100. In this illustrated example, air entering through intake 202 and flowing into the engine compartment 212 may provide air for operation and/or cooling of the propulsion system 208 such as by providing air to a combustion engine and/or to carry away heat produced by the propulsion system 208. Air may exit the internal compartment 210 and be discharged to the exterior of the hull 216 through another opening, here the air outlet 214, which in this example is provided with a fluid tight ventilation closure 200. Thus, air exiting the internal compartment 210 passes through the fluid tight ventilation closure 200 as it exits through the opening 214. In the embodiment shown in FIG. 2, the intake 202 is located at a longitudinally forward location of the hull and the internal compartment 210, which is shown here as extending along a portion of the length of the boat 100. As such the intake 202 is forward of the outlet 214, which may facilitate a better airflow through the internal compartment 210, e.g., as the boat 200 moves forward as indicated by arrow 215. In the embodiment shown in FIG. 2, the fluid tight ventilation closure 200, which in this example is associated with the outlet 214, is located aft of the intake 202 and/or at an aft end of the internal compartment 210. In other embodiments, the low profile vent assembly 200 can be associated with other openings and/or located in other positions of the internal compartment 210, such as a fore position. In various embodiments, low profile vent assembly 200 can be located at any position to the port or starboard of a midline of the boat 100. In the embodiments shown in the figures, the low profile vent assembly 200 is located at an air outlet 214. However, a low profile vent assembly 200 can be located at an air intake 202, or at an air outlet 214 and an air intake 202 without departing from the scope of the present disclosure.

In some embodiments, the low profile vent assembly 200 includes at least one air flow control device (e.g., damper 312), a fluid-tight ventilation closure 203, and a drain system 320. The fluid-tight ventilation closure 203 may include a valve 304. In the embodiment shown, the low profile vent assembly 200 is coupled to an air mover 308. In other embodiments, the low profile vent assembly 200 might not be coupled to an air mover 308, or an air mover 308 might be present elsewhere in the internal compartment 210.

Figure 3:
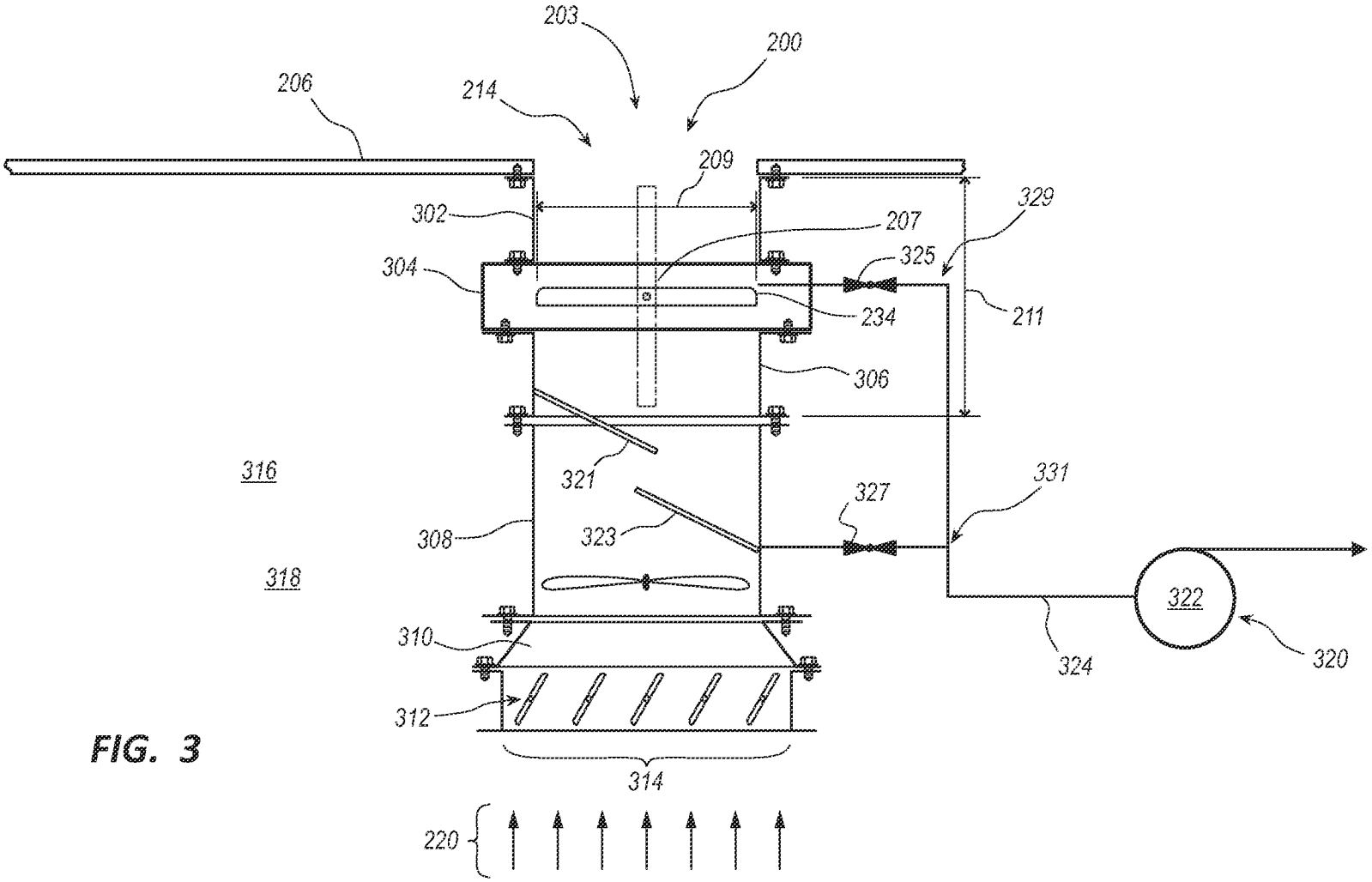
FIG. 3 illustrates an example of the low profile vent assembly in FIG. 2.

A valve refers to any device selectively actuated by an actuator to start or stop the flow of fluid through a conduit, such as a butterfly, gate, knife, ball, globe, pinch, plug, flap, diaphragm, or other similar device according to the present disclosure. The valve 304 is fluid tight, preventing the ingress of water into the engine compartment 212 when in a closed position. In the open position, the valve 304 allows discharge air 220 to pass out of the engine compartment 212. The valve 304 can be actuated by any suitable actuator. As illustrated in FIG. 3, the valve 304 has a movable barrier 234. Spool portions 302, 306, or 310 can be used to couple the components of the low profile vent assembly 200 to one another and/or the boat 100. In some embodiments, the spool portions 302 and 306 may couple to a valve housing, or may be integral with the valve 304 housing. The spool portions 302, 306 and valve housing may be sized to fully accommodate the barrier 234 irrespective of the position of the barrier 234 (e.g., open, closed, or anywhere between open and closed positions). For example, in some embodiments, the valve 304 may be implemented as a butterfly type valve which is coupled to the hull and downstream components using one or more spool portions 302, 306 to provide a sufficient length of the housing of the valve. In other embodiments, the spool portions 302, 306 (above and below) may be integrated with the central portion of the housing to which rotatably supports the valve barrier 234. In some embodiments, fewer or no spool portions 302, 306, or 310 are used. For instance, embodiments that utilize a valve 304 other than butterfly valve may not be equipped with spool portions 302, 306, or 310. The components of the low profile vent assembly 200 can be either welded, clamped, bolted, screwed, tied or glued together.

In the embodiment illustrated in FIG. 3, the damper 312 includes a plurality of vanes 314. The vanes 314 can rotate about respective longitudinal axes to move between open and closed positions. The vanes 314 can take any rotational position between fully open and fully closed positions. Thus, the vanes 314 can modulate or control the amount of gas (e.g. air) flow through the internal compartment 210. In a more closed position, the vanes 314 tend to cause relatively less air to flow through the internal compartment 210. Likewise, in the more open position, the vanes 314 allow relatively more air to flow through the internal compartment 210. Thus, the damper 312 can modulate a flow of air through the internal compartment 210. The vanes 314 can be actuated by any suitable actuator. "Actuator" refers to any device that converts energy from one form (such as pneumatic, hydraulic, electrical, or stored elastic energy) into motion, such as a motor, servo, belt or gear drive, hydraulic or pneumatic actuator, solenoid, power screw, spring or other resilient element, or a combination of the above.

In a preferred embodiment, the damper 312 is a fire-rated damper. A fire damper 312 prevents the spread of fire, and in some embodiments smoke, throughout the boat 100. The fire damper 312, by way of reducing or stopping air flow through the engine compartment 212, can starve a fire of oxygen needed to burn, and thus act to suppress or extinguish a fire.

In the event of a fire, the damper 312 is automatically shut by an actuator to prevent or reduce air ingress into the engine compartment 212. A fire damper 312 may be activated by a variety of sensors or actuators. In some embodiments, the fire damper 312 is activated by a sensor that detects a rise in temperature in the engine compartment 212 to above a certain threshold, or detects a time rate of temperature rise and generates a control signal to actuate an actuator to close the damper. In another embodiment, the fire damper 312 is activated by a smoke detector. In another embodiment, the fire damper 312 is activated by a flame detector that senses certain wavelengths of light such as ultraviolet or infrared light. In another embodiment, the fire damper 312 is activated by a thermal camera. In another embodiment, the fire damper 312 is activated by an emergency activation button, pressed by a person on the boat 100, such as an emergency stop button. In another embodiment, the fire damper 312 is activated by a general fire suppression system in the boat 100.

The drain system 320 drains water or other liquid that may ingress into the low profile vent assembly 200. Such water may ingress due to splashing of water outside the boat 100 during operation, water that ingresses as the valve 304 is closing before the valve 304 is made fluid tight, or partial or total failure of the valve 304. Although shown schematically, the drain system 320 can include passages or conduits 324 within or connected to the components of the low profile vent assembly 200. The conduits 324 may collect ingress water to a common point for disposal or processing. In some embodiments, the drain system 320 includes a pump 322 that discharges collected ingress water outside the boat 100.

The drain system 320 may be adapted to remove two phase fluid mixtures, such as mixtures of water and air, such as by including one or more deaerators. In some embodiments, the drain system 320 may be adapted to operate when only gases, such as air, are present without damage. In some embodiments, the drain system 320 has multiple fluid collection points, such as shown for example in FIG. 3, with an upper collection point 329 disposed near an upper surface of the barrier 234, and a lower collection point 331 associated with a baffle 323. When the barrier 234 is in a closed position, fluid such as a liquid, may collect above the barrier 234. Such liquid may be collected at the collection point 329 and directed into the conduit 324 for disposal or processing by the pump 322. In some embodiments, the drain system 320 includes baffles such as baffles 321 and 323 disposed within a spool portion, such as the spool portion 306 and/or the air mover 308. The baffles 321 and 323 direct liquid that has ingressed into the low profile vent assembly to collection points (e.g., collection point 331) for removal and disposal by the drain system 320. For example, as shown in FIG. 3, if a fluid such as water enters the low profile vent assembly 200, it may contact the upper baffle 321 and drip or run by gravity off the baffle 321 and onto the baffle 323. The baffle 323 directs the liquid to the collection point 331 at the intersection of the baffle and the shroud of the air mover 308. From the collection points, the liquid (and possibly a non-liquid fluid such as air) enters the conduit 324 and is withdrawn by the pump 322 for disposal (e.g., to a bilge, or is expelled from the boat).

In some embodiments, the flow of fluid through the conduit 324 is controlled by one or more valves, such as valves 325 and 327 that receive fluid from the collection points 329 and 331, respectively. The valves 325, 327 may allow the flow of fluid from the collection points 329, 331 when open, and prevent it when closed. The valves 325, 327 may be controlled together, such that they are both open or closed together, or they may be operated independently. In some embodiments, a valve may regulate the flow of fluid through the conduit, allowing flow to increase or decrease as desired. In some embodiments, one valve may control the flow of liquid to more than one collection point. In other embodiments, the flow of liquid from some collection points may be controlled by a valve, while the flow from other collection points may not be controlled by a valve.

The boat 100 can include a number of devices and systems that automatically detect the ingress of water into the low profile vent assembly 200 or the internal compartment 210, or the threat of such ingress, and automatically close the fluid-tight ventilation closure 203. In some embodiments, the detection of ingress water can be manual, such as being sensed by a person on the boat 100.

In some embodiments, the boat 100 includes a water infiltration sensor 316. A water infiltration sensor 316 detects ingress water that has entered the low profile vent assembly 200. In some embodiments the detection of water ingress is automatic. A water infiltration sensor 316 generates a signal in response to the detection of water. The signal may be sensed by a controller such as a processor that generates a control signal in response, and the control signal may cause an actuator to actuate to close the valve 304. The boat 100 can include a water infiltration sensor 316 that includes a conductivity sensor that detects the presence of an electrical current between two conductors caused by the presence of water. In other embodiments, the water infiltration sensor 316 is a float sensor that detects an accumulated volume of water in a vessel or conduit, such as a vessel associated with the drain system 320.

As shown in FIG. 3, the discharge air 220 first passes through the damper 312. The internal compartment 210 is connected to the damper 312. The discharge air 220 may be pulled out of the internal compartment 210 by an optional air mover 308. The discharge air may then pass through a valve 304, when the valve 304 is in an open position. Although in the embodiment shown in FIG. 3, the damper 312, air mover 308, and valve 304 are shown in a particular order with respect to the flow of the discharge air 220, other arrangements or orders of the components of the low profile vent assembly 200 are contemplated within the scope of the present disclosure.

The air mover 308 moves air through the internal compartment 210. Typically, an air mover 308 creates a vacuum at its intake, and a positive pressure at its outlet, thereby causing a movement of air through the air mover 308. As shown in the embodiment of FIG. 2, the air mover 308 pulls fresh air into the internal compartment 210 and discharges discharge air 220 out of the internal compartment 210. Arranged in this manner, the air mover 308 draws a vacuum relative to the surroundings. In other embodiments, the air mover 308 can be arranged to pull fresh air in through a low profile vent assembly 200 and push that air into the internal compartment 210. Arranged in this manner, the air mover 308 pressurizes the internal compartment 210. In various embodiments, the air mover 308 is a fan, blower, compressor, venturi, turbine, or the like. The air mover 308 can be an axial fan or an centrifugal fan.

In some embodiments, the boat 100 can include a motion sensor 318 that detects motion or position information of the boat 100, such as, angular or linear motion or position of the boat 100. In some embodiments, the motion sensor 318 can detect listing, pitching, yawing, or rolling of the boat 100. The motion sensor 318 can detect when the boat 100 has rolled or pitched beyond a limit with respect to a horizontal axis that runs athwartships, or an axis that runs along a longitudinal midline of the boat 100. In some embodiments, the motion sensor 318 can detect that the boat 100 has yawed beyond a limit with respect to an axis that runs vertically through the boat 100. The motion sensor 318 can, in some embodiments, detect any one, two, or three of roll, pitch, or yaw. In some embodiments, the motion sensor 318 can detect linear motion such as surging, swaying, or heaving of the boat 100. In some embodiments, the motion sensor 318 is an accelerometer or similar device that can detect the acceleration, velocity, and/or position of the boat 100, and/or changes to the same. In other embodiments, the motion sensor 318 is a gyroscope, or similar device.

Information about the motion or position of the boat 100 such as detected by the motion sensor 318 can be correlated to, or used to determine that, the low profile vent assembly 200 is at risk of downflooding. In some embodiments, motion or position information can be combined with draught or freeboard information to determine when the low profile vent assembly 200 is at risk of downflooding. Such information may be used, such as by a controller or processing element, to generate a signal in response to the risk of downflooding. The controller may generate a control signal in response, and the control signal may cause an actuator to actuate to close the valve 304.

If the low profile vent assembly 200 becomes a concern for water ingress and stability/flooding, for instance as detected by the water infiltration sensor 316 or the motion sensor 318, or manually, an actuator can be enabled to close the fluid-tight ventilation closure 203, for instance by closing a fluid tight valve 304. When the condition that caused the concern of downflooding passes, the fluid-tight ventilation closure 203 can automatically or manually re-open.

In some embodiments, two or more low profile vent assemblies 200 can be located at port and starboard sides of the boat 100. Thus, if the boat 100 rolls to port, fluid-tight ventilation closure 203 of the port-side low profile vent assembly 200 can close, and the starboard fluid-tight ventilation closure 203 of that low profile vent assembly 200 can remain open, allowing air to continue to pass through the internal compartment 210. Likewise, if the boat 100 rolls to starboard, the fluid-tight ventilation closure 203 of the starboard-side low profile vent assembly 200 can close, and the fluid-tight ventilation closure 203 of the port side low profile vent assembly 200 can remain open, allowing air to continue to pass through the internal compartment 210.

Figure 4:
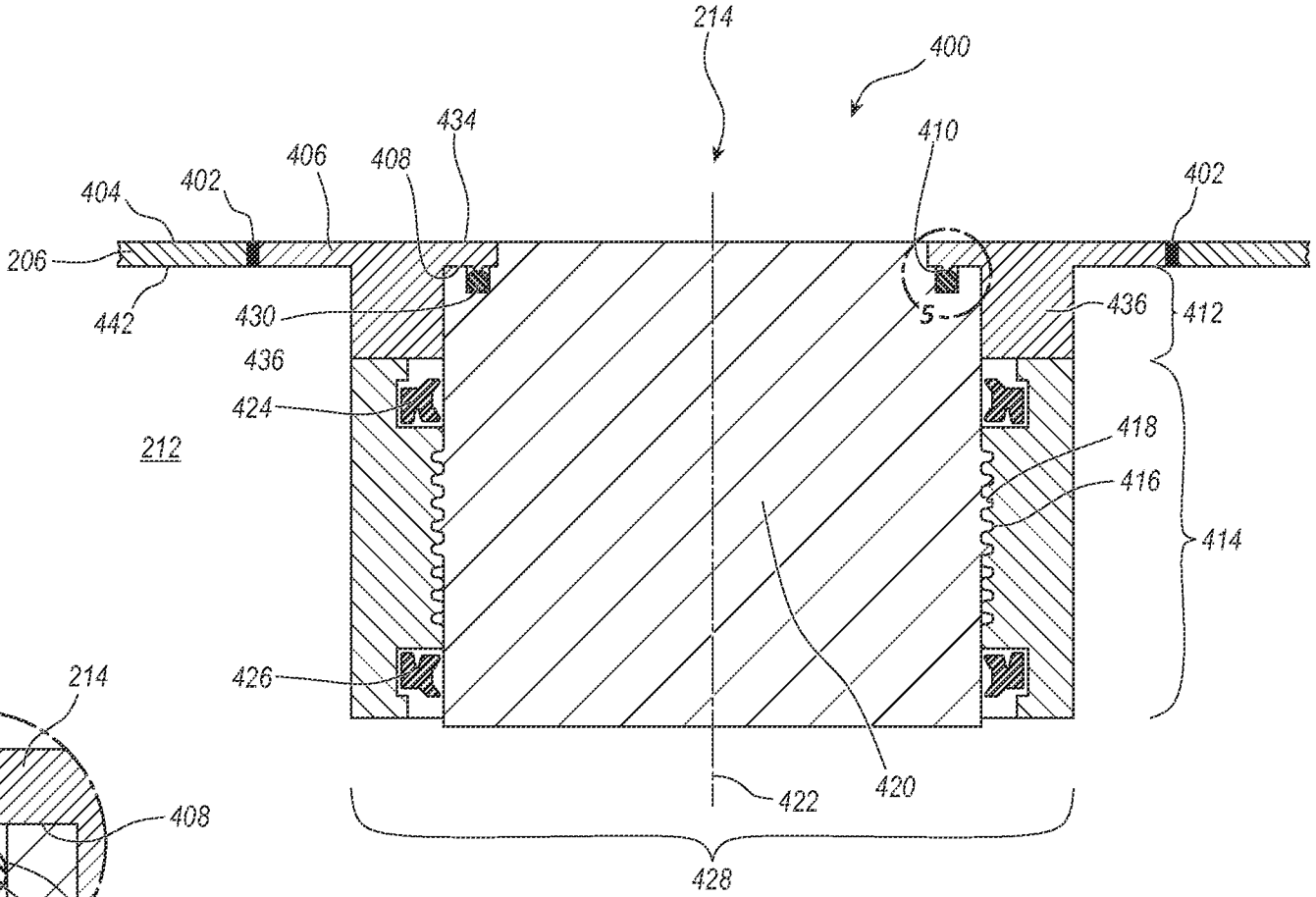
FIG. 4 is a cross section of a valve for selectively sealing fluid flow though the low profile vent assembly according to the present disclosure, the valve being shown in a closed configuration in FIG. 4.
Figure 5:
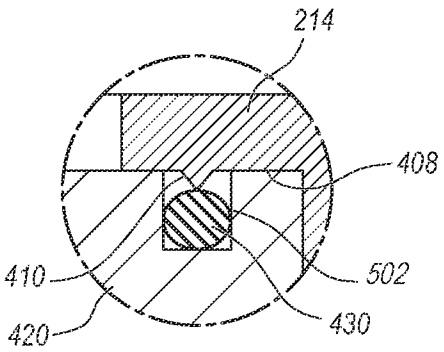
FIG. 5 is an enlarged view of portion of the valve in FIG. 4.

FIG. 4 is a cross-section view through a portion of the deck 206 illustrating an embodiment of a valve 400 suitable to implement the valve 304 of FIG. 3 of a fluid-tight ventilation closure 203 and suitable for use in a low profile vent assembly 200 according to the present disclosure. As shown in FIG. 2, the valve 400 may be operatively associated with engine compartment 212 to selectively seal a ventilation port such as the air outlet 214 or the air intake 202. The valve 400 may be positioned across an opening in the vessel's hull which serves as an air outlet 214. For example, the valve 400 may be inserted into an opening defined in an outer surface 404 of the deck 206 (defined in this embodiment between welds 402).

In the present example, the valve 400 has a generally cylindrical construction, however in other examples, other suitable non-cylindrical geometries may be used. For example, the valve 400 may include a tubular section extending into the engine compartment 212, or another part of the fluid-tight ventilation closure 203 that has an ovular, rectangular or other regular or irregular transverse geometry, and may be operatively associated with a block, shaft, or plug that has a corresponding transverse geometry for cooperating fit within the tube. The valve 400 may be configured to be coupled (e.g., fixedly or rigidly coupled) to the deck 206.

In some examples, the valve 400 may have a peripheral flange 406 extending peripherally around the air outlet 214. The air outlet 214 or air intake 202 can be a substantially circular hole or aperture defined in the deck 206 or the flange 406 that allows fluid communication from the peripheral inner surface 408 of the valve 400 to the outer surface 404 of the deck 206. In other embodiments of valves, the descriptions herein of an air outlet 214 are equally applicable to an air intake 202; the air outlet 214 is used to enhance brevity and clarity. The valve 400 may be fixed to the deck 206 (or other hull surface) via the flange 406. The air outlet 214 may be a screen with a plurality of air channels (i.e., holes, gaps, vent passages, or openings) that function as air outlets. The air outlet 214 may be rigidly attached to the adjacent portions of the outer surface 404 of the deck 206, such as, for example, by welds 402, fasteners, rivets, interlocking parts, or any other type of attachment mechanism for rigidly coupling components that is known in the art. The valve 400 may be coupled to the boat hull such that the outer surface 434 of the valve 400 and outer surface 404 of the deck 206 are substantially coplanar, thereby forming a substantially continuous deck surface substantially free of any gaps, steps or other discontinuities aside from openings for the air channels. In other embodiments, the air outlet 214 can be integrally formed with the deck 206 as a single piece For example, the deck 206 may include a protrusion 410, and other features of the valve 400.

The peripheral inner surface 408 may include a protrusion 410 extending around the peripheral inner surface 408. The protrusion 410 may be referred to as a sealing ridge or circular sealing or engagement member that surrounds the peripheral inner surface 408. The protrusion 410 may be part of a sealing interface, as described in further detail below and in other descriptions herein. The protrusion 410 may have a pointed cross-section and may therefore be referred to as a "knife edge," wherein the pointed cross-section forms a sharp edge or ridge configured to come into contact with, and apply focused pressure against, a resilient seal 430 on the shaft structure 420, as explained in further detail below and in other descriptions herein.

A cylinder structure 428 may extend inward from the flange 406 at the peripheral inner surface 408. Therefore, the cylinder structure 428 may be positioned within the engine compartment 212 at a surface. In some embodiments, the cylinder structure 428 can be formed within a channel or conduit that connects the interior of the engine compartment 212 to the deck 206. The peripheral inner surface 408 may be a top inner surface of the engine compartment 212 (e.g., the topmost outer surface 404 of the deck 206).

Figure 6:
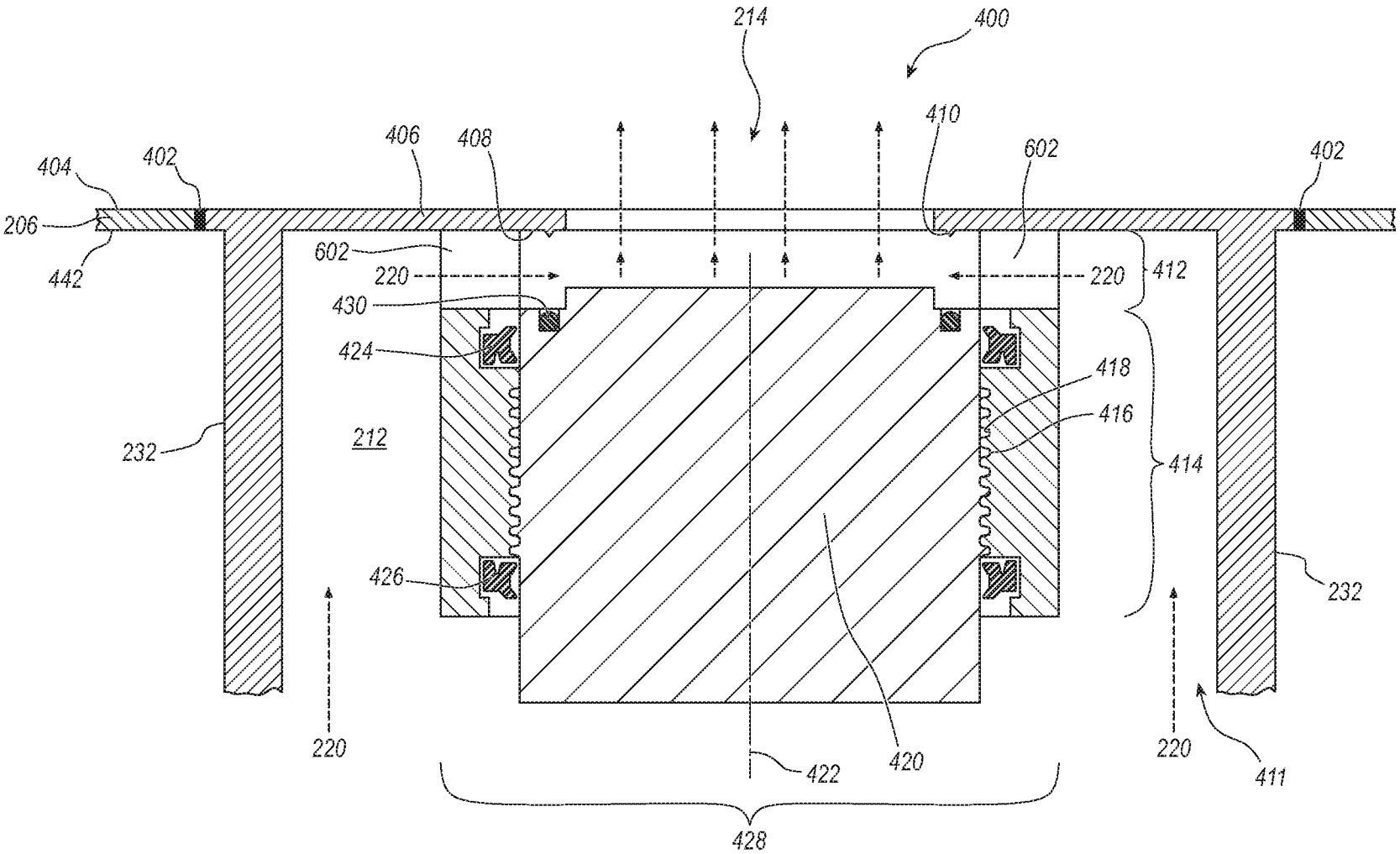
FIG. 6 is a cross section of the valve of FIG. 4, shown here in an open configuration.

A top end of the cylinder structure 428 may include a passage portion 412. FIG. 6 shows a section view of the valve 400 in an open position with air passing through the passage portion 412, The passage portion 412 extends downward from the peripheral inner surface 408, The passage portion 412 includes a series of circumferentially spaced apart openings 602 that provide fluid communication between the engine compartment 212 and the air outlet 214. The shape and positioning of these circumferentially spaced apart openings 602 may make the passage portion 412 have a generally castellated shape with a set of wall portions 436 separated by the circumferentially spaced apart openings 602. In this embodiment, the passage portion 412 has eight circumferentially spaced apart openings 602 spaced around its sides, but fewer openings such as just one opening, may be sufficient to operate the valve 400. By having eight circumferentially spaced apart openings 602 or another number of multiple large openings, it may be easier for air that is in the engine compartment 212 to pass through the passage portion 412 on all sides of the passage portion 412, thereby increasing ventilation and/or reducing the power of the air mover 308. The valve 400 may include a housing 232 that contains the cylinder structure 428. The housing 232 may define an annular space between it and the cylinder structure 428 through which fluid flows (e.g., air, which can be intake air, or as illustrated, discharge air 220).

In some embodiments, some or all of the circumferentially spaced apart openings 602 may extend from the peripheral inner surface 408 to the lower end 414 of the cylinder structure 428. In some embodiments, some or all of the openings may extend along less than the entire longitudinal dimension of the passage portion 412. The circumferentially spaced apart openings 602 can extend along a portion of the top end of the passage portion 412, a bottom end thereof, or a middle portion thereof. By positioning the circumferentially spaced apart openings 602 at a top end of the passage portion 412, the openings can be positioned at a topmost edge of the valve 400 and at the topmost end of the engine compartment 212.

A shaft structure 420 may be positioned within the cylinder structure 428 and may move relative to the cylinder structure 428 and relative to the air outlet 214. Thus, the cylinder structure 428 can laterally surround the shaft structure 420. The shaft structure 420 may translate vertically upward and downward within the cylinder structure 428, as illustrated in FIG. 4 and FIG. 6.

A resilient seal 430, such as an o-ring, rubber seal, flexible plastic seal, or similar structure, may extend around the top end of the shaft structure 420 in a position on the shaft structure 420 that corresponds to the protrusion 410 on the peripheral inner surface 408 of the air outlet 214. See FIG. 5, which is a detailed view of the area within FIG. 4. A retaining groove 502, channel, or depression at the top end of the shaft structure 420 may hold the resilient seal 430 in place on the shaft structure 420 as the shaft structure 420 translates or rotates within the cylinder structure 428, as seen by comparing FIG. 4 and FIG. 6.

When the shaft structure 420 is at the top of its range of travel and the resilient seal 430 is in contact with protrusion 410, the shaft structure 420 (and the valve 400 as a whole) may be referred to as being a closed or sealed state, as shown in FIG. 4. The contact between the resilient seal 430 and the protrusion 410 may be fluid tight, airtight, or otherwise fluid tight in a manner that ensures that water does not ingress into the internal compartment 210 of the boat 100. Fluids, whether air or water, cannot pass through the circumferentially spaced apart openings 602 when the valve 400 is in the closed state. Accordingly, the internal compartment 210 can be prevented from taking on water through the air outlet 214 while the valve 400 is in the sealed state.

When the shaft structure 420 is at a lower position along its range of travel, such as in the position shown in FIG. 6, the resilient seal 430 is not in contact with the protrusion 410, and the shaft structure 420 and the valve 400 as a whole may be referred to as being in an open, venting, or unsealed state. In FIG. 6, the section view is rotated relative to the section view of FIG. 4, to show circumferentially spaced apart openings 602 and how they provide fluid communication between the exterior and interior of the cylinder structure 428. The separation of the resilient seal 430 from the protrusion 410 and the presence of the circumferentially spaced apart openings 602 in the passage portion 412 of the cylinder structure 428 may allow discharge air 220 air to flow from the area inside of internal compartment 210 surrounding the cylinder structure 428 through the circumferentially spaced apart openings 602, as shown by the flow arrows in FIG. 6.

Thus, the shaft structure 420 may be rotated to translate between the closed state and the open state of the valve 400. For example, the shaft structure 420 may have a longitudinal axis 422 about which the shaft structure 420 rotates, and a set of mating threads 416 that mate with threads 418 on the cylinder structure 428 may guide the shaft structure 420 upward and downward between the sealed and unsealed configurations of the valve 400 as it rotates relative to the cylinder structure 428. The threads 416 may be male threads disposed on an outer surface of the shaft structure 420. The threads 418 may be female threads disposed on an inner surface of the cylinder structure 428. The threads 416 and 418 may threadedly couple the shaft structure 420 to the cylinder structure 428 to effectuate the linear translation of the shaft structure 420 relative to the cylinder structure 428 by relative rotation of the shaft structure 420 to the cylinder structure 428. An upper gasket 424 and a lower gasket 426 may be positioned on opposite ends of the mating and engaged threads 416 and threads 418 prevent ingress of debris or other contaminants between the threads. One or more of the gaskets can be referred to as wiper seals that are configured to clean off the threads 416, 418 as they rotate in contact with the appropriate lower gasket 426 or upper gasket 424. In the embodiment shown, the lower gasket 426 and upper gasket 424 are located in respective recesses at ends of the cylinder structure 428. In an alternative embodiment one or both of the upper gasket 424 and/or lower gasket 426 are located in the shaft structure 420.

In the embodiment shown, the shaft structure 420 and the cylinder structure 428 include mating and engaged threads 416 and threads 418, respectively, and the valve 400 is suitable for actuation by an actuator such as a power screw, servo, motor, or other rotary actuator. An actuator such as, for example, a motorized shaft or lever, may be mounted to the shaft structure 420 and may be used to induce rotation of the shaft structure 420 relative to the cylinder structure 428. The actuator may be operated remotely, thereby allowing the valve 400 to be opened and closed by a user that does not have manual access to the internal compartment 210. In this way, the air flow through the internal compartment 210 of the boat 100 can be manipulated by a person without having to access the fluid tight ventilation closure 200.

Thus, the low observability characteristics of the shape and freeboard configuration of the boat 100 can be preserved as the fluid-tight ventilation closure 203 of the low profile vent assembly 200 is operated. In other words, a crew member does not need to emerge from the inside of the boat 100 in order to operate the fluid-tight ventilation closure 203. In some embodiments, the actuator is positioned entirely within internal compartment 210, but in some cases the actuator can be only partially within the internal compartment 210, such as, for example, by having a rotatable link that extends to the shaft structure 420 at one end and having a motor joined to an opposite end of the link external to the internal compartment 210.

In other embodiments, the shaft structure 420 may not include threads 418 and the cylinder structure 428 may not include threads 416. The shaft structure 420 and the inner surface of the cylinder structure 428 may then have relatively smooth cylindrical surfaces. Thus, the shaft structure 420 can slide linearly in the cylinder structure 428 without twisting, such as would be induced by threads, much as a piston slides within a cylinder. Such embodiments may be suitable for actuation by an actuator such as a hydraulic or pneumatic ram, solenoid, or other linear actuator. In such embodiments, the lower gasket 426 and the upper gasket 424 may be lip seals that are configured to wipe or clean the shaft structure 420 or the cylinder structure 428. Some such embodiments may be faster to actuate than the embodiment shown in FIG. 4 and FIG. 5.

Figure 7:
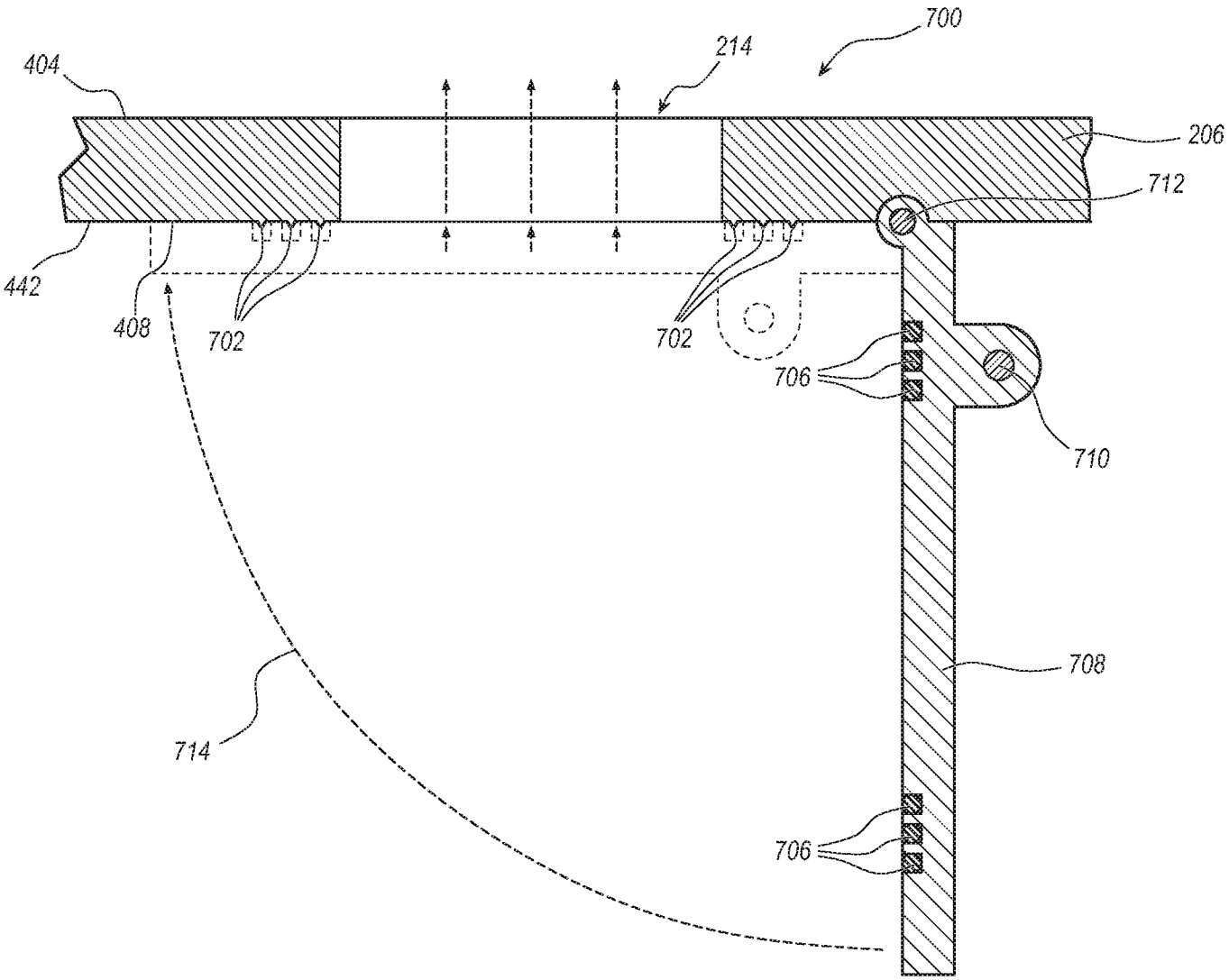
FIG. 7 illustrates another example of a valve for selectively sealing fluid flow though the fluid-tight ventilation closure of the present disclosure, the valve being shown in an open configuration in FIG. 7, and illustrating also the closed state of the valve of this example.

FIG. 7 is a side section view of an alternate embodiment of a valve 700 for use in a fluid-tight ventilation closure 203 of a low profile vent assembly 200. The valve 700 is suitable to implement the valve 304 of FIG. 3 and is suitable for use in a fluid-tight ventilation closure 203 according to the present disclosure. The valve 700 may be referred to as a pivoting valve or door valve. The pivoting valve 700 may close or seal off the air outlet 214 using a pivotable cover plate 708. The air outlet 214 may be mounted to the deck 206 using the same techniques as described above. The peripheral inner surface 408 of the valve 700 may be coplanar with the inner surface 442 of the deck 206. The valve 700 or the deck 206 may comprise a set of protrusions 702 that correspond to resilient members 706 in or on the cover plate 708. The set of protrusions 702 and resilient members 706 may have shapes and functions similar to the protrusion 410 and resilient seal 430 of valve 400 to provide a sealing interface. As shown in FIG. 7, a set of protrusions 702 may be concentric and correspond to a set of three concentric resilient members 706, and when the cover plate 708 is in a closed position as indicated by the closing motion arrow 714, the set of protrusions 702 may contact and form a seal with the resilient members 706. Using a set of protrusions 702 and resilient members 706 may provide improved reliability for the sealing function of the cover plate 708 since failure of a seal between one of the set of protrusions 702 and one of the resilient members 706 may be compensated for by one or more of the other sets of sealing interface components.

The cover plate 708 may be mounted to the deck 206 by a hinge 712. The hinge 712 may be positioned at an extreme end of the cover plate 708 so that the rotation of the cover plate 708 may rotate the entire cover plate 708 away from the inner surface 408 of the air outlet 214. The cover plate 708 is shown in an unsealed or open condition in FIG. 7. As indicated by the arrows in FIG. 7, when the cover plate 708 is rotated about the hinge 712, air may escape through the air outlet 214. The cover plate 708 may be configured to rotate about 90 degrees between the closed position and the fully open position shown in FIG. 7. An airtight, fluid tight, or other fluid tight interface may prevent the ingress of water when the cover plate 708 is in the closed position. Although the cover plate 708 is shown in FIG. 7 as being rotatable about a pivot axis that extends perpendicular to the page, in some embodiments, the cover plate 708 can be configured to rotate about a pivot axis that extends vertically in FIG. 7 and thereby rotates away from the air intake 202 by pivoting into or out of the page.

In some embodiments, the cover plate 708 may be connected to an actuator at an actuator connection point 710. For example, a telescoping hydraulic or pneumatic arm, a geared arm, a cam-and-follower mechanism, a motorized or manual lever, a power screw, or similar actuation devices, and combinations thereof may apply a force to the cover plate 708 at the actuator connection point 710 to cause the cover plate 708 to rotate about the hinge 712 between the open position of FIG. 7 and a closed position as indicated by the closing motion arrow 714. The cover plate 708 rotates inward, i.e., into the interior of the internal compartment 210 and therefore does not affect the appearance, aesthetics, or other observability characteristics of the air outlet 214 or the outer surface 404 of the deck 206.

From the foregoing it will be appreciated that, although specific embodiments have been described herein for purposes of illustration, various modifications may be made while remaining within the scope of the claimed technology.

Examples described herein may refer to various components as "coupled" or signals as being "provided to" or "received from" certain components. It is to be understood that in some examples the components are directly coupled one to another, while in other examples the components are coupled with intervening components disposed between them. Similarly, signal may be provided directly to and/or received directly from the recited components without intervening components, but also may be provided to and/or received from the certain components through intervening components.

Various examples of the present disclosure have been described in detail above to facilitate an understanding of the invention. It will be recognized by those skilled in the art that many variations to the examples described are possible without departing from the scope and spirit of the invention disclosed herein, and that the scope of the claimed invention is defined by the claims listed below. The terms "including" and "having" as used in the specification and claims shall have the same meaning as the term "comprising."

What is claimed is:

1. A vent assembly comprising:

a vent conduit coupling a dry compartment of a boat to an opening in an exterior surface of the boat for selectively fluidly connecting the dry compartment to an exterior of the boat;

a valve which selectively prevents fluid flow through the vent conduit when the valve is in a closed position, wherein the valve is positioned below the exterior surface and comprises:

a housing that defines a passage that forms a portion of the vent conduit; and a barrier mechanism movable relative to the housing between the closed position and an open position, in Which open position fluid flow through the vent conduit is permitted; and a damper configured to selectively modulate air flow through the vent conduit, wherein the damper is positioned such that the valve is fluidically between the opening and the damper.

2. The vent assembly of claim 1, wherein the housing is a cylindrical tubular housing.

3. The vent assembly of claim 2, Wherein the barrier mechanism is configured to translate relative to the housing between the open position and the closed position.

4. The vent assembly of claim 3, wherein the barrier mechanism is a cylindrical block that translates linearly within the cylindrical tubular housing.

5. The vent assembly of claim 4, wherein:

the barrier mechanism includes male threads on a surface thereof; and the cylindrical tubular housing includes female threads on a surface thereof, wherein the male threads are operatively couplable to the female threads such that the barrier mechanism is threadedly coupled to the cylindrical tubular housing to effectuate the linear translation by rotation of the barrier mechanism relative to the cylindrical tubular housing.

6. The vent assembly of claim 5, wherein a gasket is positioned in a recess at an end of the cylindrical tubular housing mating and engages the male threads to prevent ingress of debris or other contaminants between the male threads and female threads.

7. The vent assembly of claim 4, wherein the barrier mechanism comprises a rotating plate having a length and connected to the housing to pivot about an axis perpendicular to the length, and wherein a height of the housing is equal to or greater than the length of the rotating plate.

8. The vent assembly of claim 1, wherein the barrier mechanism is configured to pivot relative to the housing between the open position and the closed position.

9. The vent assembly of claim 8, wherein the barrier mechanism is a circular plate that pivots about a rotational axis between the closed position and the open position, the rotational axis being orthogonal to a longitudinal axis of the housing.

10. The vent assembly of claim 1, further comprising a drain conduit fluidly connected to the housing at a location between the opening and the barrier mechanism.

11. The vent assembly of claim 10, further comprising a plurality of drains conduit fluidly connected to the housing at a location between the opening and the barrier mechanism.

12. The vent assembly of claim 1, wherein the valve comprises:

a flange fixed to a deck of the boat;

an aperture defined in the flange that allows fluid communication from a peripheral inner surface to an outer surface of the deck;

a protrusion extending around the peripheral inner surface;

a cylinder structure extending inward into the dry compartment from the peripheral inner surface of the valve below the flange, the cylinder structure including:

a passage portion including a plurality of circumferentially spaced apart openings that provide fluid communication between the dry compartment and the aperture, a shaft structure positioned within the cylinder structure and operable to move relative to the cylinder structure and relative to the aperture, the shaft structure including;

a retaining groove at a top end of the shaft structure, and a resilient seal disposed in the retaining groove and operable to seal against the protrusion to prevent an ingress of water into the boat.

13. The vent assembly of claim 12, wherein:

the shaft structure includes:

a longitudinal axis about which the shaft structure rotates, and a set of shaft structure threads; and the cylinder structure includes a set of cylinder threads that mate with the shaft structure threads such that the cylinder structure guides the shaft structure upward and downward between a sealed and an unsealed configuration of the valve as the shaft structure rotates relative to the cylinder structure.

14. The vent assembly of claim 1, further comprising an air mover configured to move air through the dry compartment of the boat.

15. The vent assembly of claim 1, further comprising a water ingress sensor that detects an ingress of water.

16. The vent assembly of claim 15, wherein the water ingress sensor is one of a conductivity sensor or a float sensor.

17. The vent assembly of claim 1, wherein the valve is closed upon a detection of a condition corresponding to a threat of an ingress of water into the dry compartment of the boat.

18. The vent assembly of claim 17, wherein the detection of the condition is correlated to one of a roll, a pitch, or a yaw of the boat.

19. The vent assembly of claim 18, wherein one of the roll, the pitch, or the yaw is detected by an accelerometer.

20. The vent assembly of claim 18, wherein the detection of the condition is correlated to a listing of the boat.

21. The vent assembly of claim 17, wherein the valve is closed automatically in response to the detection of the condition.

22. The vent assembly of claim 1, wherein the damper is fire-rated and is configured to close upon detection of a fire.

23. The vent assembly of claim 22, wherein the fire is detected by a sensor that detects one of:

a temperature of the dry compartment rising above a threshold;

a presence of smoke in the dry compartment;

a time rate of temperature rise; or a wavelength of light associated with the fire.

24. A method of preventing downflooding of a boat comprising:

providing the low profile vent assembly of claim 1;

detecting a condition corresponding to a threat of an ingress of water into the dry compartment of the boat;

generating a control signal in response to the detection of the condition;

actuating an actuator in response to the control signal; and closing the valve by the actuator.

25. The method of claim 24, further comprising detecting the condition corresponding to one of a roll, a pitch, or a yaw of the boat.

26. The method of claim 24, further comprising detecting the condition corresponding to a listing of the boat.

27. The method of claim 24, further comprising:

detecting a fire;

generating a second control signal in response to the detection of the fire;

actuating a second actuator in response to the second control signal; and closing the damper by the second actuator.

28. The method of claim 27, wherein the detecting of the fire comprises detecting one of:

a temperature of the dry compartment rising above a threshold;

a presence of smoke in the dry compartment;

a time rate of temperature rise; or a wavelength of light associated with the fire.

29. A vent assembly comprising:

a vent conduit coupling a dry compartment of a boat to an opening in an exterior surface of the boat for selectively fluidly connecting the dry compartment to an exterior of the boat;

a fluid-tight ventilation closure which selectively prevents fluid flow through the vent conduit when the fluid-tight ventilation closure is in a closed position, wherein the fluid-tight ventilation closure is positioned below the exterior surface of the boat;

a damper configured to selectively modulate air flow through the vent conduit, wherein the damper is positioned such that the fluid-tight ventilation closure is fluidically between the opening and the damper; and a sensor that detects ingress of water or accumulation of water in the vent assembly.

30. The vent assembly of claim 29, wherein the sensor is one of a conductivity sensor or a float sensor.

31. A vent assembly comprising:

a vent conduit coupling a dry compartment of a boat to an opening in an exterior surface of the boat for selectively fluidly connecting the dry compartment to an exterior of the boat;

a fluid-tight ventilation closure which selectively prevents fluid flow through the vent conduit when the fluid-tight ventilation closure is in a closed position, wherein the fluid-tight ventilation closure is positioned below an exterior surface, wherein the fluid-tight ventilation closure is automatically closed upon a detection of a condition corresponding to a threat of an ingress of water into the dry compartment of the boat; and a damper configured to selectively modulate air flow through the vent conduit, wherein the damper is positioned such that the fluid-tight ventilation closure is in fluidically between the opening and the damper.

* * * * *